US006891116B2

(12) United States Patent
Dove et al.

(10) Patent No.: US 6,891,116 B2
(45) Date of Patent: May 10, 2005

(54) SUBSTRATE WITH LIQUID ELECTRODE

(75) Inventors: Lewis R. Dove, Monument, CO (US); Marvin Glenn Wong, Woodland Park, CO (US); Mitsuchika Saito, Kawasaki (JP)

(73) Assignee: Agilent Technologies, Inc., Palo Alto, CA (US)

( * ) Notice: Subject to any disclaimer, the term of this patent is extended or adjusted under 35 U.S.C. 154(b) by 75 days.

(21) Appl. No.: 10/414,128

(22) Filed: Apr. 14, 2003

(65) Prior Publication Data

US 2004/0200706 A1 Oct. 14, 2004

(51) Int. Cl.[7] ..... H01H 29/00
(52) U.S. Cl. ..... 200/182; 200/183
(58) Field of Search ..... 200/61.47, 182, 200/187–193, 197, 199, 214, 221, 222, 236, 226–229, 239

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |

(Continued)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

Bhedwar, Homi C., et al. "Cermanic Multilayer Package Fabrication", Electronic Materials Handbook, Nov. 1989, pp 461–469, vol. 1 Packaging, Section 4: Packages.

Kim, Joonwon, et al., "A Micromechanical Switch With Electrostatically Driven Liquid–Metal Droplet", Sensors And Actuators, A; Physical v 9798. Apr. 1, 2002, 4 pages.

Marvin Glenn Wong, U.S. App. No. 10/137,691 (pending), "Piezoelectrically Actuated Liquid Metal Switch", May 2, 2002.

J. Simon, et al., "A Liquid–Filled Microrelay with a Moving Mercury Microdrop", Journal of Microelectromachanical Systems, vol. 6, No. 3, Sep. 1997, pp. 208–216.

*Primary Examiner*—Elvin Enad
*Assistant Examiner*—Lisa Klaus

(57) ABSTRACT

A substrate, a method for producing a substrate, and a switch incorporating a substrate are disclosed. In one embodiment, the substrate has a first layer, a first electrode deposited on the first layer, and a second layer mated to the first layer. The second layer defines a duct leading from the first electrode to a surface of the second layer opposite the first electrode. A liquid electrode fills at least a portion of the duct.

26 Claims, 4 Drawing Sheets

U.S. PATENT DOCUMENTS 4,336,570 A 6/1982 Brower
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,105,433 A * 4/1992 Eisele et al. ..... 372/50
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 * 11/2001 Kondoh et al. ..... 200/182
6,351,579 B1 2/2002 Early et al.
6,356,679 B1 3/2002 Kapany
6,373,356 B1 * 4/2002 Gutierrez et al. ..... 335/47
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 * 1/2003 Fong et al. ..... 310/328
6,515,404 B1 * 2/2003 Wong ..... 310/328
6,516,504 B2 2/2003 Schaper
6,559,420 B1 5/2003 Zarev
6,633,213 B1 10/2003 Dove
6,646,527 B1 * 11/2003 Dove et al. ..... 335/47
6,717,495 B2 * 4/2004 Kondoh et al. ..... 335/47
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

SUBSTRATE WITH LIQUID ELECTRODE

BACKGROUND OF THE INVENTION

Liquid metal micro switches (LIMMS) have been made that use a liquid metal, such as mercury, as the switching fluid. The liquid metal may make and break electrical contacts. To change the state of the switch, a force is applied to the switching fluid, which causes it to change form and move. However, the movement of the mercury over the contacts can sometimes decrease the reliability of the switch.

SUMMARY OF THE INVENTION

In one embodiment, a substrate is disclosed that comprises a first layer and a second layer. An electrode is deposited on the first layer. The first layer is mated to the second layer. The second layer defines a duct that leads from the first electrode to a surface of the second layer opposite the first electrode. A liquid electrode fills at least a portion of the duct.

BRIEF DESCRIPTION OF THE DRAWINGS

Illustrative embodiments of the invention are illustrated in the drawings in which.

DETAILED DESCRIPTION

Figure 1:
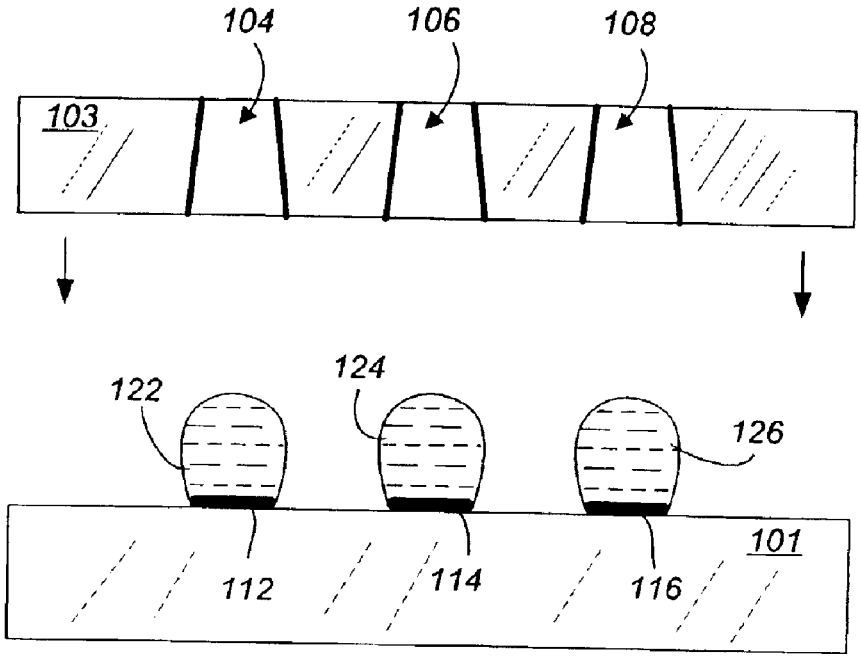
FIG. 1 illustrates an elevation of a first exemplary embodiment of a first layer and a second layer that may be used in a substrate for a fluid-based switch.
Figure 2:
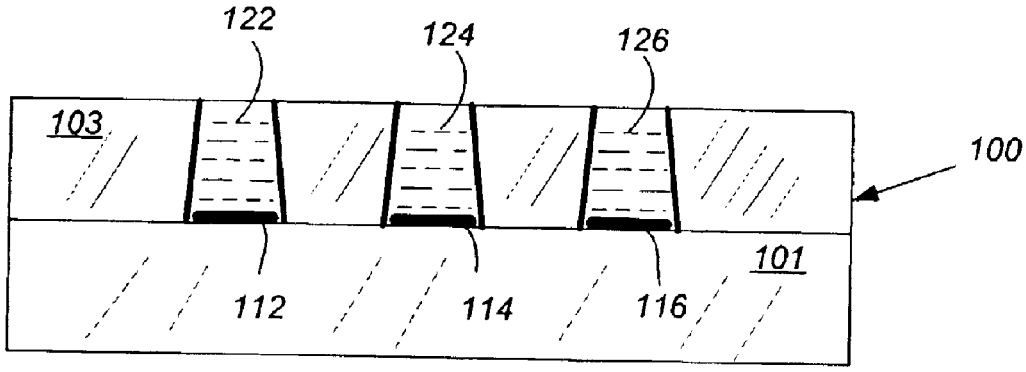
FIG. 2 illustrates the first and second layers of FIG. 1 mated together to form a substrate that may be used in a fluid-based switch.

FIGS. 1 and 2 illustrate a substrate 100 that may be used in a fluid-based switch such as a LIMMS. As illustrated by the method set forth in FIG. 3, the substrate 100 may be produced by depositing 300 a number of electrodes 112, 114, 116 on a first layer 101. By way of example, the electrodes may be solid electrodes and the first layer may be formed from (or comprise) a ceramic material. Other suitable materials may also be used, such as polymer or glass.

Next, a liquid electrode 122, 124, 126 is deposited 305 on each of the previously deposited electrodes 112, 114, 116. In one embodiment, the liquid electrodes may be a liquid metal electrodes, such as mercury electrodes. As will be described in further detail below, the liquid electrodes may be used in conjunction with a switching fluid in a fluid-based switch to make and break contact connections between the electrodes 112, 114, 116.

The second layer 103 defines a plurality of ducts 104, 106, 108. These ducts are aligned 310 with the electrodes 112, 114, 116, 122, 124, 126 deposited on the first layer 101 so that when the layers are mated together 315, each of the liquid electrodes 122, 124, 126 is forced through at least a portion of the duct with which it is aligned.

The substrate 100 may be used in a fluid-based switch such as a LIMMS. The ducts 104, 106, 108 may be used to help prevent switching fluid used in the switch from moving over the electrodes 112, 114, 116 as the switching fluid makes and breaks contact between the electrodes. By way of example, the ducts 104, 106, 108 may be tapered, so that an opening of the duct at its respective electrode 112, 114, 116 is wider than an opening of the duct at the surface of the second layer opposite the electrodes 112, 114, 116. In a fluid-based switch, switching fluid above the ducts may then make and break connections between the electrodes 112, 114, 116 by merging with the liquid electrodes 122, 124, 126 rather than by wetting and rewetting the electrodes 112, 114, 116. This can increase the reliability of the switch. If the ducts are tapered, the tapered shape of the ducts tends to cause the liquid electrodes 122, 124, 126 to remain within their respective ducts 104, 106, 108 and not move over the electrodes 112, 114, 116, thus increasing the reliability of the switch.

In one embodiment, the walls of the ducts may be lined with a wettable material to help the liquid electrodes 122, 124, 126 wet to the ducts 104, 106, 108. By way of example, the material of the second layer 103 may be formed from (or comprise) glass. However, the second layer could also be formed from materials such as polymers or ceramics. The ducts may be made wettable by metallizing the glass defining the ducts (e.g., via sputtering).

In some environments, it may be difficult to form tapered ducts such as those depicted in FIG. 1. An alternate substrate that may be used in a fluid-based switch to help reduce the movement of switching fluid over electrodes is therefore depicted in FIG. 4. The substrate 400 includes a first layer 401, a second layer 403 mated to the first layer 401, and a third layer 405 mated to the second layer 403. By way of example, the first layer may be formed from (or comprise) ceramic, and the second and third layers may be formed from (or comprise) glass or ceramic. Other suitable materials are also contemplated.

The second layer 403 defines a plurality of ducts 402, 404, 406 leading from electrodes 422, 424, 426 deposited on the first layer 401 to the surface of the second layer opposite the electrodes 422, 424, 426. The third layer defines extensions 412, 414, 416 of the ducts 402, 404, 406 that lead from the surface of the second layer to an opposite surface of the third layer. The extensions of the ducts 412, 414, 416 are narrower than the ducts 402, 404, 406. Liquid electrodes (e.g., mercury electrodes) 432, 434, 436 fill at least a portion of each of the ducts. At least a portion of the walls of the ducts defined by the second layer 403 and the third layer 405 may be lined with a wettable material to help the liquid electrodes 432, 434, 436 wet to the ducts 402, 404, 406.

In one embodiment, the substrate 400 may be used in a fluid-based switch. The shape of the ducts formed through the second and third layers of the substrate may cause the liquid electrodes 432, 434, 436 deposited within each of the ducts to remain within the duct as switching fluid makes and breaks contact between electrodes 422, 424, 426, thus increasing the reliability of the switch.

Figure 3:
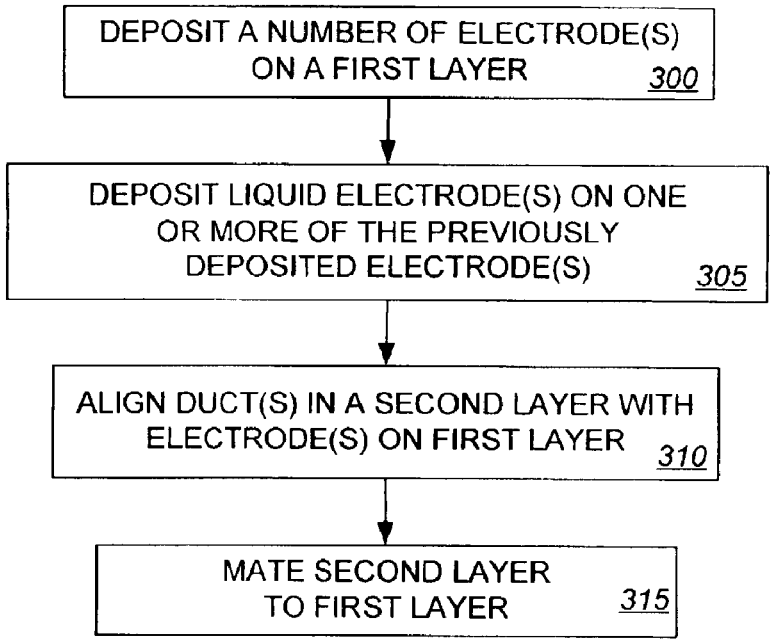
FIG. 3 illustrates an exemplary method for making a substrate such as that depicted in FIG. 2.
Figure 4:
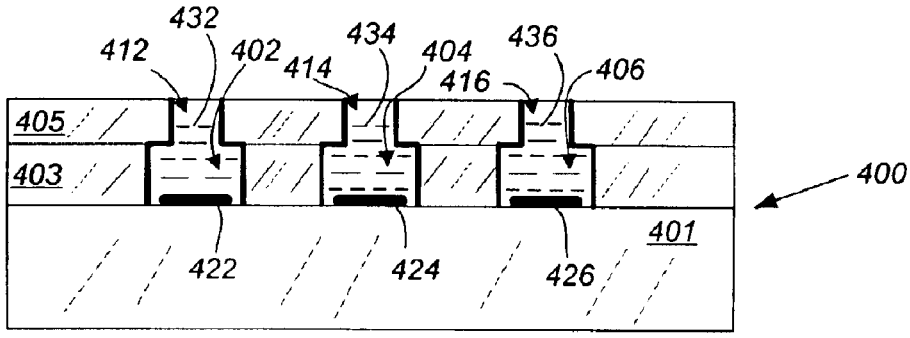
FIG. 4 illustrates a second exemplary embodiment of a substrate that may be used in a fluid-based switch.

The substrate of FIG. 4 may be formed using a process similar to that described in FIG. 3. Prior to mating 315 the second layer 403 to the first layer 401, the smaller diameter ducts 412, 414, 416 of the third layer 405 may be aligned with the ducts 402, 404, 406 of the second layer 403, and the third layer 405 may be mated to the second layer 403.

Figure 5:
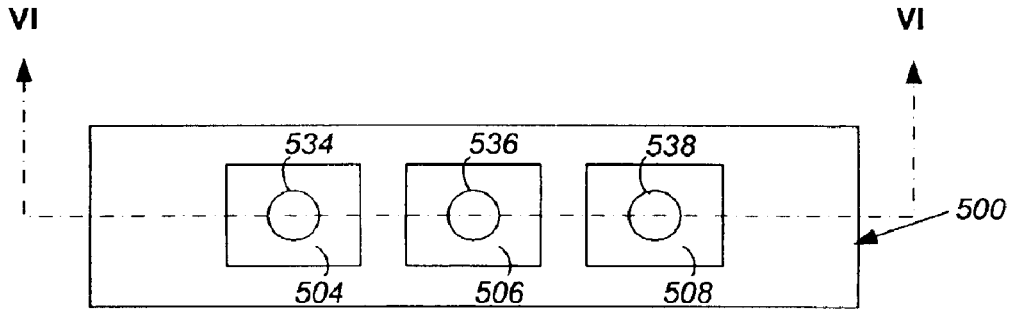
FIG. 5 illustrates a plan view of a third exemplary embodiment of a substrate that may be used in a fluid-based switch.
Figure 6:
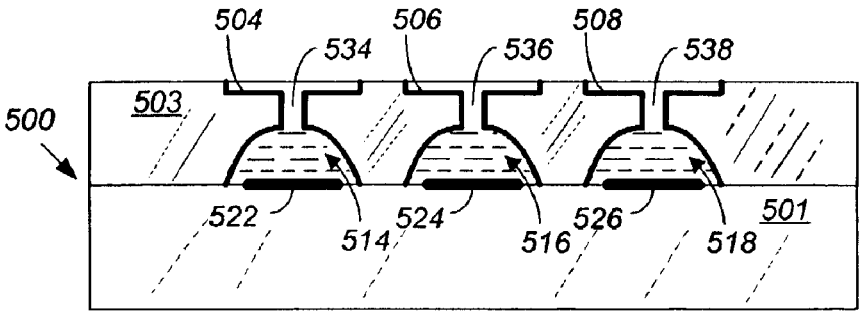
FIG. 6 illustrates an elevation of the substrate shown in FIG. 5.

FIGS. 5 and 6 illustrate a third exemplary embodiment of a substrate 500 that may be used in a fluid-based switch. A plurality of electrodes 522, 524, 526 are deposited on a first layer 501 of the substrate. A second layer 503 is then mated to the first layer 501. By way of example, the second layer may be formed from (or comprise) glass, and the first layer may be formed from (or comprise) a ceramic material. Other suitable materials are also contemplated.

The second layer defines a plurality of ducts 514, 516, 518 that lead from the electrodes 522, 524, 526 to a surface of the second layer 503 opposite the electrodes 522, 524, 526. The ducts comprise a bell shape, with the openings of the ducts at the electrodes being wider than the openings of the ducts at the opposite surface of the second layer. The bell shape may have a variety of profiles and may be formed, for example, by masking the second layer and then sandblasting the bell shape(s) into the second layer. Optionally, indentations 504, 506, 508 defined by the second layer may be used to recede the openings of the ducts from the surface of the second layer. The indentations have a diameter larger than that of the ducts at the surface of the second layer. It should be appreciated that alternate embodiments may not have the indentations depicted in FIG. 6.

Liquid electrodes (e.g., mercury electrodes) 534, 536, 538 fill at least a portion of each of the ducts. The walls of the ducts may be lined with a wettable material to help the liquid electrodes 534, 536, 538 wet to the ducts. The indentations may also be lined with a wettable material so that a switching fluid used in a fluid-based switch may wet to the indentations.

In one embodiment, the substrate 500 is used in a fluid-based switch. The shape of the ducts 514, 516, 518 may cause the liquid electrodes 534, 536, 538 deposited within each of the ducts to remain within their respective ducts as a switching fluid makes and breaks connections between the electrodes 522, 524, 526. The indentations 504, 506, 508 provide a greater contact area for the liquid electrodes 534, 536, 538, and the recessed edges of the indentations may help prevent the wettable linings from lifting their edges and moving out of the indentations.

Figure 7:
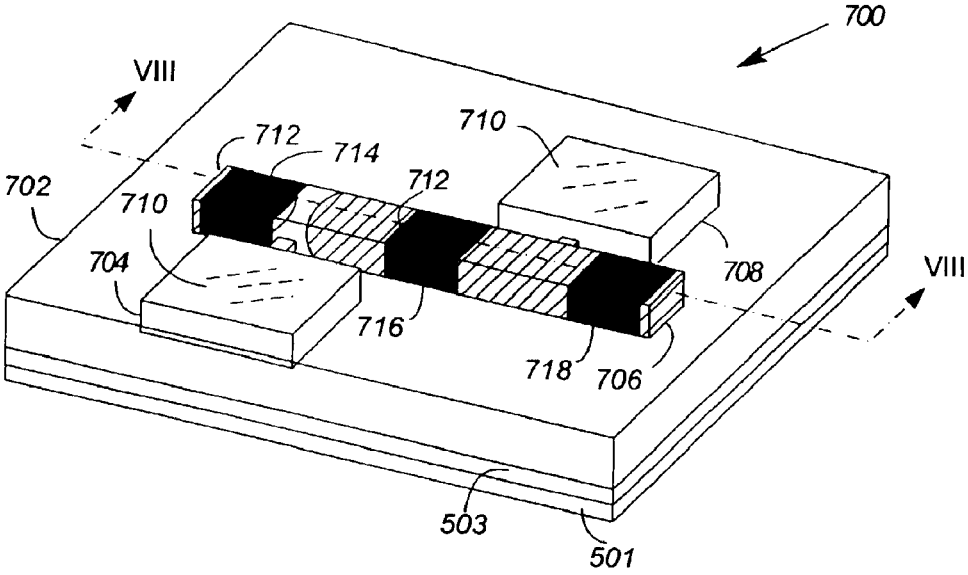
FIG. 7 illustrates a perspective view of a first exemplary embodiment of a switch that may use a substrate including ducts.
Figure 8:
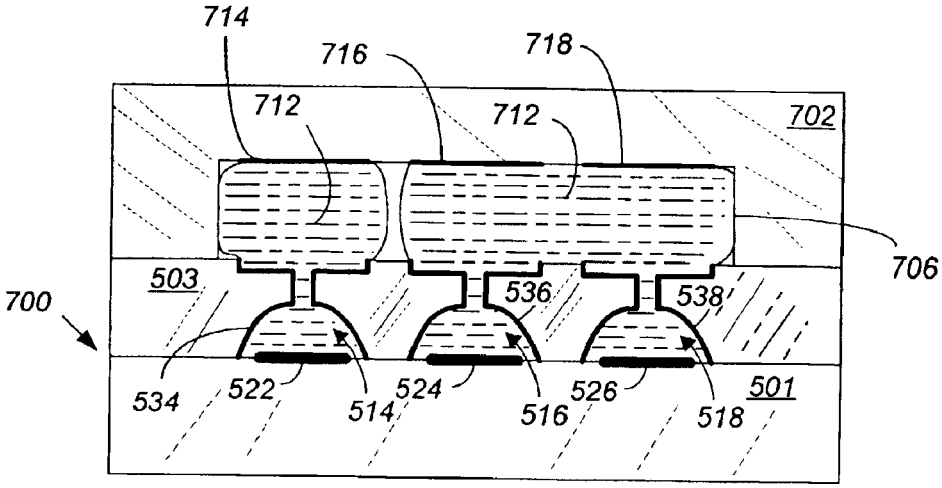
FIG. 8 illustrates an elevation of the switching fluid cavity of the switch shown in FIG. 7.

FIGS. 7 and 8 illustrate a first exemplary embodiment of a fluid-based switch. The switch 700 comprises a first substrate, having a first layer 501 and a second layer 503. A second substrate 702 is mated to the first substrate 501/503. The substrates 501/503, 702 define between them a number of cavities 704, 706, 708.

The second layer 503 defines a number of ducts 534, 536, 538 (FIG. 8), each of which leads from at least one of the cavities to one of a plurality of electrodes 522, 524, 526 on the first layer 501 of the substrate. A switching fluid 712 (e.g., a conductive liquid metal such as mercury) is held within the ducts 534, 536, 538 and one or more of the cavities (e.g., cavity 706). The switching fluid 712 serves to open and close at least a pair of the plurality of electrodes 522, 524, 526 in response to forces that are applied to the switching fluid 712. An actuating fluid 710 (e.g., an inert gas or liquid) held within one or more of the cavities (e.g., cavities 704, 708) serves to apply the forces to the switching fluid 712.

Portions of the first substrate 702 may be metallized for the purpose of creating "seal belts" 714, 716, 718. The creation of seal belts 714–718 within a cavity 706 holding switching fluid 712 provides additional surface areas to which the switching fluid 712 may wet. This not only helps in latching the various states that a switching fluid can assume, but also helps to create a sealed chamber from which the switching fluid cannot escape, and within which the switching fluid may be more easily pumped (i.e., during switch state changes).

In one embodiment of the switch 700, the forces applied to the switching fluid 712 result from pressure changes in the actuating fluid 710. The pressure changes in the actuating fluid 710 impart pressure changes to the switching fluid 712, and thereby cause the switching fluid 712 to change form, move, part, etc. In FIG. 7, the pressure of the actuating fluid 710 held in cavity 704 applies a force to part the switching fluid 712 as illustrated. In this state, the rightmost pair of electrodes 524, 526 of the switch 700 are coupled to one another (see FIG. 8). If the pressure of the actuating fluid 710 held in cavity 704 is relieved, and the pressure of the actuating fluid 710 held in cavity 708 is increased, the switching fluid 712 can be forced to part and merge so that electrodes 524 and 526 are decoupled and electrodes 522 and 524 are coupled.

As the switch changes state, the liquid electrodes 514, 516, 518 (i.e., portions of the switching fluid 712) tend to remain within the ducts 534, 536, 538 so that the switching fluid 712 does not have to wet and rewet the electrodes 522, 524, 526. Thus, the movement of the switching fluid over the electrodes is at least decreased, and preferably eliminated. As described elsewhere in this application, the ducts may be tapered, bell-shaped, or of any other shape that tends to cause the liquid electrodes 514, 516, 518 to remain wetted to the electrodes 522, 524, 526. The second layer 503 may further define indentations at the openings of the ducts within the cavities 704, 706, 708, for purposes previously described.

Pressure changes in the actuating fluid 710 may be achieved by means of heating the actuating fluid 710, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIGS. 7 & 8 may be found in the afore-mentioned patent of Kondoh.

While illustrative and presently preferred embodiments of the invention have been described in detail herein, it is to be understood that the inventive concepts may be otherwise variously embodied and employed. For example, a substrate similar to that shown in FIGS. 1, 2, or 4–6 may also be used in an optical switch that uses an opaque liquid to open or block light paths. The appended claims are intended to be construed to include such variations, except as limited by the prior art.

What is claimed is:

1. A substrate comprising:

a first layer;

a first electrode deposited on the first layer;

a second layer mated to the first layer, the second layer defining a duct leading from the first electrode to a surface of the second layer that is opposite the first electrode; and a liquid electrode filling at least a portion of the duct.

2. The substrate of claim 1, wherein an opening of the duct at the first electrode is wider than an opening of the duct at the surface of the second layer.

3. The substrate of claim 2, wherein the duct comprises a bell shape.

4. The substrate of claim 1, wherein the second layer of the substrate comprises an indentation at an opening of the duct at the surface of the second layer, the indentation having a diameter that is larger than that of the duct at the surface of the second layer.

5. The substrate of claim 4, further comprising a wettable material lining walls of the indentation.

6. The substrate of claim 1, further comprising a wettable material lining walls of the duct.

7. The substrate of claim 6, wherein the second layer comprises glass and the wettable material comprises metal.

8. The substrate of claim 6, wherein the second layer comprises ceramic and the wettable material comprises metal.

9. The substrate of claim 1, wherein the first electrode is a solid electrode.

10. The substrate of claim 1, further comprising a third layer mated to the second layer, the third layer defining an extension of the duct leading from the surface of the second layer to an opposite surface of the third layer, the extension of the duct being narrower than the duct.

11. A substrate produced by:

depositing a first electrode on a first layer;

depositing a liquid electrode on the first electrode;

aligning a duct in a second layer with the first electrode on the first layer; and mating the second layer to the first layer, forcing the liquid electrode through the duct.

12. The substrate of claim 11, further comprising:

aligning a smaller diameter duct in a third layer with the duct in the second layer; and mating the third layer to the second layer prior to mating the second layer to the first layer.

13. The substrate of claim 11, wherein the second layer comprises glass.

14. The substrate of claim 11, wherein the second layer comprises ceramic.

15. A switch comprising:

a first substrate having a first layer and a second layer, the first layer having a plurality of electrodes deposited thereon, and the second layer defining a number of ducts;

a second substrate mated to the first substrate, the first substrate and the second substrate defining therebetween at least portions of a number of cavities, each duct of the second layer leading from at least one of the cavities to one of the plurality of electrodes deposited on the first layer;

a switching fluid, held within one or more of the ducts and one or more of the cavities, at least a portion of which is movable to open and close at least a pair of the plurality of electrodes in response to forces that are applied to the switching fluid; and an actuating fluid, held within one or more of the cavities, that applies the forces to the switching fluid.

16. The switch of claim 15, wherein at least one of the ducts defined by the second layer is defined so that a portion of the switching fluid remains in the duct when the forces are applied to the switching fluid to close pairs of the electrodes.

17. The switch of claim 15, wherein at least one of the ducts defined by the second layer is defined so that an opening of the duct at one of the electrodes is wider than an opening of the duct at one of the cavities.

18. The switch of 15, wherein the second layer comprises an indentation at shape.

19. The switch of claim 15, wherein the second layer comprises an indentation at an opening of the duct at the surface of the second layer, the indentation having a diameter that is larger than that of the duct at the surface of the second layer.

20. The switch of claim 19, further comprising a wettable material lining walls of the indentation.

21. The switch of 15, wherein the second layer comprises glass.

22. The switch of claim 15, wherein the second layer comprises ceramic.

23. The switch of claim 15, further comprising a wettable material lining walls of the duct.

24. The switch of claim 23, wherein the second layer comprises glass and the wettable material comprises metal.

25. The switch of claim 23, wherein the second layer comprises ceramic and the wettable material comprises metal.

26. The switch of claim 15, wherein the first substrate further comprises a third layer mated to the second layer, the third layer defining an extension of the duct leading from the surface of the second layer to an opposite surface of the third layer, the extension of the duct being narrower than the duct.

* * * * *

UNITED STATES PATENT AND TRADEMARK OFFICE

CERTIFICATE OF CORRECTION

PATENT NO. : 6,891,116 B2
APPLICATION NO. : 10/414128
DATED : May 10, 2005
INVENTOR(S) : Lewis R. Dove, Marvin Glenn Wong and Mitsuchika Saito It is certified that error appears in the above-identified patent and that said Letters Patent is hereby corrected as shown below:

In the Claims

Column 6, Line 24 After "wherein", delete "the second layer comprises an indentatation at" and insert therefor --at least one of the ducts comprises a bell--

Signed and Sealed this

Eighth Day of January, 2008

JON W. DUDAS
*Director of the United States Patent and Trademark Office*